US009506417B2

(12) United States Patent
Ulrey et al.

(10) Patent No.: US 9,506,417 B2
(45) Date of Patent: Nov. 29, 2016

(54) METHODS FOR DETECTING HIGH PRESSURE PUMP BORE WEAR

(71) Applicant: Ford Global Technologies, LLC, Dearborn, MI (US)

(72) Inventors: Joseph Norman Ulrey, Dearborn, MI (US); Ross Dykstra Pursifull, Dearborn, MI (US); Mark Meinhart, South Lyon, MI (US); Gopichandra Surnilla, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 439 days.

(21) Appl. No.: 14/255,824

(22) Filed: Apr. 17, 2014

(65) Prior Publication Data

US 2015/0300287 A1 Oct. 22, 2015

(51) Int. Cl.

| | |
|---|---|
| ***F02M 65/00*** | (2006.01) |
| ***F02D 41/38*** | (2006.01) |
| ***F02D 41/22*** | (2006.01) |
| *F02D 41/08* | (2006.01) |
| *F02D 41/30* | (2006.01) |
| *F02D 41/14* | (2006.01) |

(Continued)

(52) U.S. Cl.

CPC ..... *F02D 41/3845* (2013.01); *F02D 41/221* (2013.01); *F02D 41/08* (2013.01); *F02D 41/3094* (2013.01); *F02D 2041/1433* (2013.01); *F02D 2041/225* (2013.01); *F02D 2200/0614* (2013.01); *F02M 59/102* (2013.01); *F02M 63/029* (2013.01); *F02M 65/002* (2013.01)

(58) Field of Classification Search

CPC .. F02D 41/3845; F02D 41/221; F02D 41/08; F02D 2200/0614; F02D 2200/0618; F02D 2041/1433; F02D 2041/225; F02M 63/0225; F02M 65/00; F02M 65/002; F02M 65/006

USPC ..... 123/446–447, 458, 198 D, 198 DB

See application file for complete search history.

(56) References Cited

U.S. PATENT DOCUMENTS

| | | | | |
|---|---|---|---|---|
| 4,790,277 A * | 12/1988 | Schechter | ..... | F02D 41/401 123/357 |
| 5,615,656 A * | 4/1997 | Mathis | ..... | F02D 41/3827 123/447 |
| 6,474,306 B2 * | 11/2002 | Muller | ..... | F02D 41/222 123/295 |

(Continued)

OTHER PUBLICATIONS

Anonymous, "Fuel Injector Diagnostics During Vehicle Decel Fuel Shutoff Mode," IPCOM No. 000239902, Published Dec. 11, 2014, 2 pages.

(Continued)

*Primary Examiner* — Thomas Moulis

(74) *Attorney, Agent, or Firm* — Julia Voutyras; Alleman Hall McCoy Russell & Tuttle LLP

(57) ABSTRACT

Methods are provided for detecting high pressure pump bore wear, wherein wear between a piston and bore of a pump may cause an excessive amount of fuel to leak out of a compression chamber of the pump. A reliable method is needed that involves a pump performance model that incorporates a number of physical effects and is verified by real high pressure pump test data. A method is proposed that involves comparing a target pump rate based on the pump performance model to a real fuel injection rate in order to determine if an abnormal amount of fuel may be leaking from the high pressure pump.

20 Claims, 7 Drawing Sheets

(51) Int. Cl.
*F02M 63/02* (2006.01)
*F02M 59/10* (2006.01)

(56) References Cited

U.S. PATENT DOCUMENTS 6,827,065 B2 12/2004 Gottemoller et al.
7,240,668 B1 7/2007 DeMinco
7,287,516 B2 * 10/2007 Elliot ..... F02M 59/366 123/486
7,556,023 B2 * 7/2009 Ilhoshi ..... F02D 41/3836 123/434
7,725,241 B2 * 5/2010 Ikeda ..... F02D 41/3845 123/359
7,735,472 B2 * 6/2010 Okamoto ..... F02D 41/22 123/179.17
7,779,814 B2 * 8/2010 Ishihara ..... F02D 41/3809 123/446
8,280,575 B2 * 10/2012 Takahashi ..... F02D 41/221 701/29.1
8,800,355 B2 * 8/2014 Toyoshima ..... F02D 41/222 123/446
9,279,404 B2 * 3/2016 Aoki ..... F02D 41/222
9,309,828 B2 * 4/2016 Nagao ..... F02D 41/3845
2002/0134358 A1 * 9/2002 Hlousek ..... F02M 45/04 123/500
2002/0139350 A1 * 10/2002 Barnes ..... F02D 41/1401 123/456
2002/0157646 A1 * 10/2002 Hiraku ..... F02D 41/3809 123/456
2005/0103312 A1 * 5/2005 Uchiyama ..... F02D 41/221 123/457
2007/0017485 A1 * 1/2007 Nakane ..... F02D 41/3845 123/457
2008/0302175 A1 * 12/2008 Puckett ..... F02D 41/221 73/114.41
2011/0023830 A1 * 2/2011 Haas ..... F02D 33/006 123/446
2011/0030655 A1 * 2/2011 Kaneko ..... F02D 41/22 123/456
2013/0218441 A1 * 8/2013 Thomas ..... F02D 41/065 701/105

OTHER PUBLICATIONS

Anonymous, "Diagnostic Method of Identifying Sticking or Delayed Opening of Fuel Injectors," IPCOM No. 000126108, Published Jun. 30, 2005, 2 pages.
Anonymous, "Strategy for Detection of Leaking Fuel Injectors," IPCOM No. 000136233, Published May 10, 2006, 2 pages.

* cited by examiner

METHODS FOR DETECTING HIGH PRESSURE PUMP BORE WEAR

FIELD

The present application relates generally to implementation of methods for detecting bore wear and abnormal fuel leak through the piston-bore interface of a high pressure fuel pump in an internal combustion engine.

SUMMARY/BACKGROUND

Some vehicle engine systems utilize both direct in-cylinder fuel injection and port fuel injection. The fuel delivery system may include multiple fuel pumps for providing fuel pressure to the fuel injectors. As one example, a fuel delivery system may include a lower pressure fuel pump (or lift pump) and a higher pressure (or direct injection) fuel pump arranged between the fuel tank and fuel injectors. The high pressure fuel pump may be coupled to the direct injection system upstream of a fuel rail to raise a pressure of the fuel delivered to the engine cylinders through the direct injectors. A solenoid activated inlet check valve, or spill valve, may be coupled upstream of the high pressure pump to regulate fuel flow into the pump compression chamber. However, when the solenoid activated inlet check valve of the high pressure fuel pump is de-energized, such as when no direct injection of fuel is requested, pump durability may be affected. Specifically, the lubrication and cooling of the pump may be reduced while the high pressure pump is not operated, thereby leading to pump degradation. Pump degradation may be manifested through wear in the interface between the pump piston and bore of the pump. The wear may cause an increase in a gap width between the piston and bore, thereby allowing an increased amount of fuel to flow through that gap compared to a normal amount of leaked fuel. The lost fuel may lead to inefficiencies in the high pressure pump as well as degraded pump and/or engine performance. Various approaches have been developed to detect bore wear that may cause excess fuel leakage through the-piston bore interface.

In one approach to detect leaking fuel from a high pressure pump, shown by Ilhoshiin et al. in U.S. Pat. No. 7,556,023, diagnosis of fuel leakage past a plunger (cylinder) of a high pressure pump is performed by a leak calculation based on a number of factors. The number of factors includes a cam angle signal, crank angle signal, water temperature signal, fuel temperature signal, and fuel pressure signal. The leak calculation calculates a leak amount that is also used to calculate a homo-elasticity coefficient of the fuel. The leak calculation also includes a viscosity coefficient that varies with the fuel temperature.

However, the inventors herein have identified potential issues with the approach of U.S. Pat. No. 7,556,023. First, the leak calculation depends on accurate readings from a large number of sensors, such as various temperatures sensors, pressure sensors, and angle sensors. If one or more sensors were to output an inaccurate value, then the leak calculation may incorrectly diagnose fuel leaking from the plunger. Furthermore, the leak calculation may not be sufficiently calibrated for expected changes in pump operation, such as those due to component wear and aging. As a result, there may be conditions where a leak is erroneously detected even though the change in pump operation is due to normal pump wear. Finally, the leak calculation only provides the diagnosis of any leak, where in many pump systems less than a threshold amount of leakage may be beneficial to pump lubrication, also referred to as normal or necessary leakage. The calculation cannot distinguish between necessary and excessive fuel leakage.

Thus in one example, the above issues may be at least partially addressed by a method, comprising: while an engine is at an idling speed: increasing pressure in a direct injection fuel rail of the engine to a threshold fuel rail pressure; computing a target pump rate of a high pressure fuel pump based on a pump performance model; computing a fuel injection rate; comparing the target pump rate and the fuel injection rate; and issuing a piston-bore interface leak result based on the comparison. In this way, the method for detecting piston bore wear may be continuously performed on-board a vehicle during conditions when the engine is idling. As described herein, the pump performance model may be calibrated based on a number of factors that affect the amount of fuel pumped from the high pressure pump, thereby improving the reliability of results generated via the model. Furthermore, the pump performance model may be compared to test data of an actual high pressure pump so that the model can be verified for its accuracy. The detection method may also be able to achieve high accuracy while relying on fewer sensors, providing component reduction benefits. In addition, the pump performance model may be periodically updated to reflect an aged high pressure pump that may perform differently than a new pump, allowing for variations in pump operation arising from common component wear and tear to be better compensated for. Finally, the detection method may better distinguish between normal and abnormal fuel leakage of the high pressure pump.

The pump performance model may be based on a number of factors, including fuel loss due to bulk modulus of the fuel and a dead volume of a compression chamber of the high pressure pump, a normal fuel leak of the pump, and a miscellaneous cause which may incorporate a number of various fuel loss contributions. The pump performance model may be graphically or numerically compared to a mapped high pressure pump to verify the accuracy of the pump model. Since the model may incorporate a normal amount of leaked fuel (which may enhance pump lubrication such as when high pressure pump operation is not requested), the aforementioned detection method may be configured to let an operator know of an abnormal fuel leakage. For example, an abnormal fuel leakage may be caused by wear between the piston and bore of the high pressure pump. By improving the accuracy and reliability of pump leak detection, pump performance is improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following detailed description provides information regarding a high pressure fuel pump and the proposed bore wear detection schemes as well as the pump performance model on which it is based. An example embodiment of a cylinder in an internal combustion engine is given in FIG. 1 while FIG. 2 depicts a fuel system that may be used with the engine of FIG. 1. An example of a high pressure pump configured to provide direct fuel injection into the engine is showed in detail in FIG. 3. As background for the bore wear detection method to determine piston-bore interface leakage, a mapping (or plot) of a high pressure pump is shown in FIG. 4 while a pump performance model is graphically shown in FIG. 5A. Also, FIG. 5B shows a plot of a mapping or a pump performance model on an alternative horizontal axis. The high pressure pump bore wear detection method is shown as a flow chart in FIG. 6, wherein a result may be issued that alerts an operator or other user whether or not normal or abnormal amount of fuel is leaking out of the high pressure pump.

Regarding terminology used throughout this detailed description, several graphs are presented wherein data points are plotted on 2-dimensional graphs. The terms graph and plot are used interchangeably to refer to the entire graph or the curve/line itself. Furthermore, a high pressure pump, or direct injection pump, may be abbreviated as a DI or HP pump. Similarly, a low pressure pump, or lift pump, may be abbreviated as a LP pump. Also, fuel rail pressure, or the value of pressure of fuel within fuel rail of the direct injectors, may be abbreviated as FRP. A pump performance model, or one or more equations used to numerically and graphically represent behavior of a high pressure pump, may be referred to as pump model or simply as a model. A normal pump-bore interface leak (or leakage) may refer to a nominal amount of fuel that escapes a compression chamber of the HP pump through the pump-bore interface. An abnormal pump-bore interface leak (or leakage) may refer to an excessive amount of fuel that escapes the compression chamber, which may be caused by pump bore wear.

Figure 1:
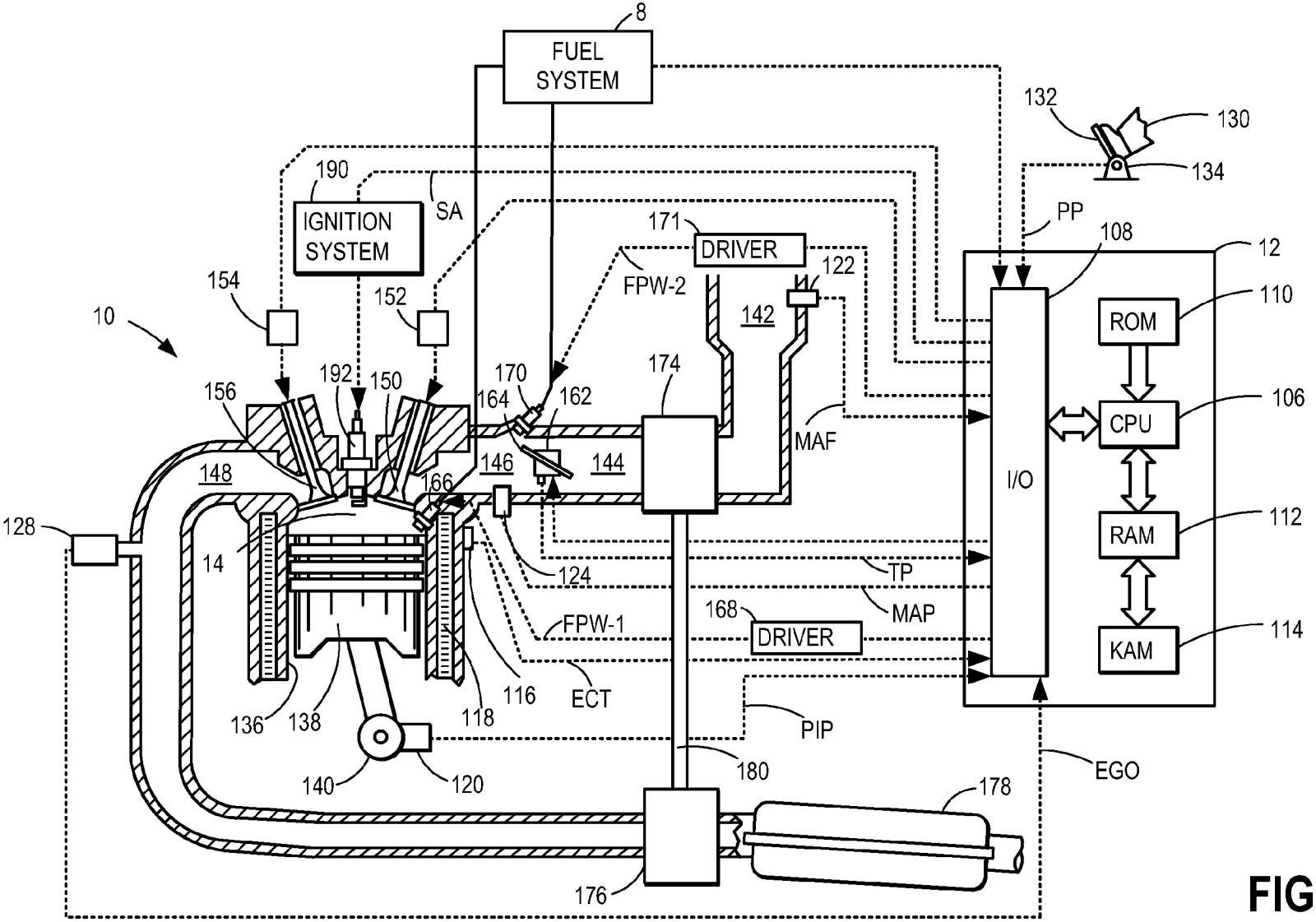
FIG. 1 schematically depicts an example embodiment of a cylinder of an internal combustion engine.
Figure 2:
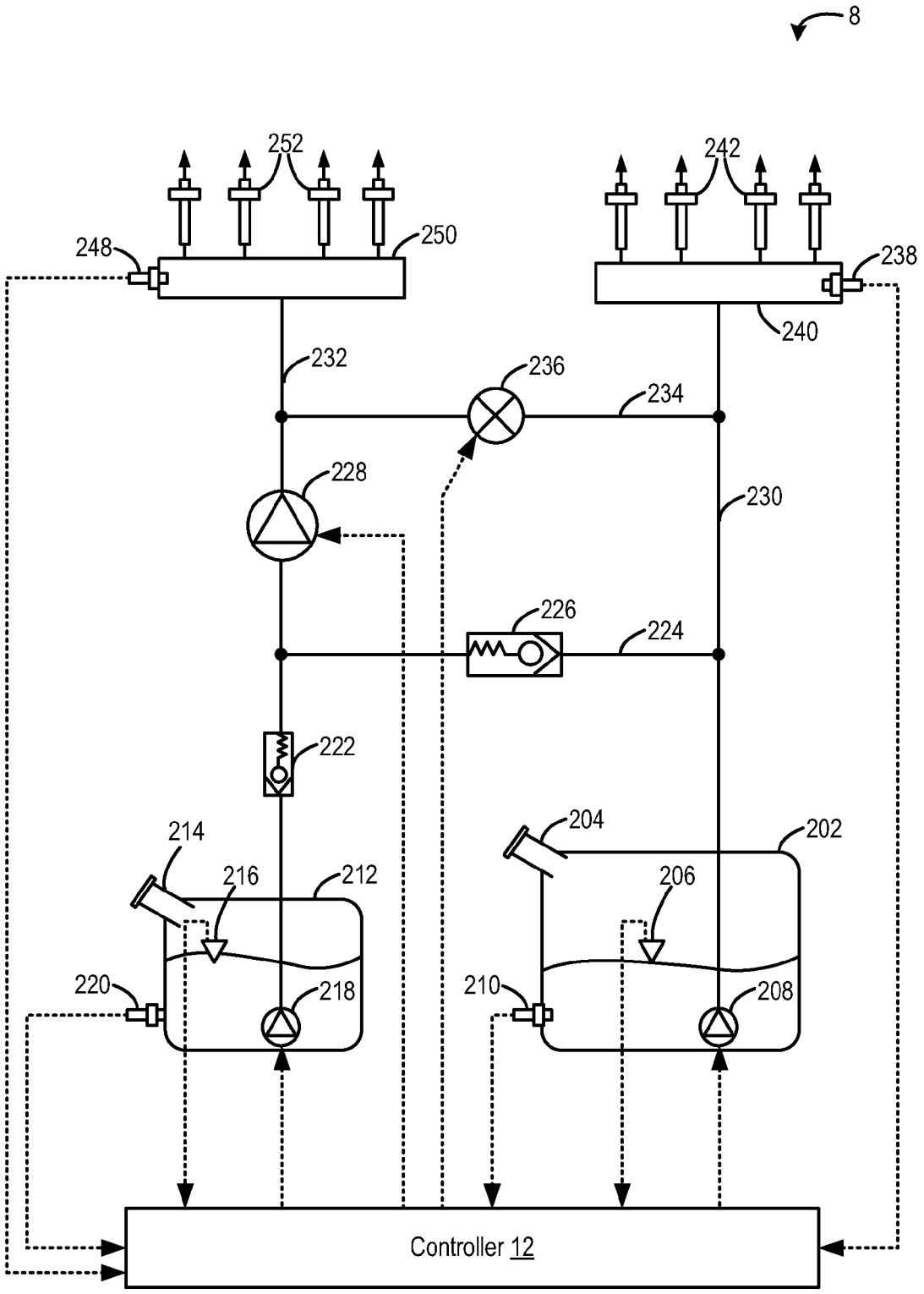
FIG. 2 schematically depicts an example embodiment of a fuel system that may be used with the engine of FIG. 1.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

FIG. 2 schematically depicts an example fuel system 8 of FIG. 1. Fuel system 8 may be operated to deliver fuel to an engine, such as engine 10 of FIG. 1. Fuel system 8 may be operated by a controller to perform some or all of the operations described with reference to the process flows of FIG. 6.

Fuel system 8 can provide fuel to an engine from one or more different fuel sources. As a non-limiting example, a first fuel tank 202 and a second fuel tank 212 may be provided. While fuel tanks 202 and 212 are described in the context of discrete vessels for storing fuel, it should be appreciated that these fuel tanks may instead be configured as a single fuel tank having separate fuel storage regions that are separated by a wall or other suitable membrane. Further still, in some embodiments, this membrane may be configured to selectively transfer select components of a fuel between the two or more fuel storage regions, thereby enabling a fuel mixture to be at least partially separated by the membrane into a first fuel type at the first fuel storage region and a second fuel type at the second fuel storage region.

In some examples, first fuel tank 202 may store fuel of a first fuel type while second fuel tank 212 may store fuel of a second fuel type, wherein the first and second fuel types are of differing composition. As a non-limiting example, the second fuel type contained in second fuel tank 212 may include a higher concentration of one or more components that provide the second fuel type with a greater relative knock suppressant capability than the first fuel.

By way of example, the first fuel and the second fuel may each include one or more hydrocarbon components, but the second fuel may also include a higher concentration of an alcohol component than the first fuel. Under some conditions, this alcohol component can provide knock suppression to the engine when delivered in a suitable amount relative to the first fuel, and may include any suitable alcohol such as ethanol, methanol, etc. Since alcohol can provide greater knock suppression than some hydrocarbon based fuels, such as gasoline and diesel, due to the increased latent heat of vaporization and charge cooling capacity of the alcohol, a fuel containing a higher concentration of an alcohol component can be selectively used to provide increased resistance to engine knock during select operating conditions.

As another example, the alcohol (e.g. methanol, ethanol) may have water added to it. As such, water reduces the alcohol fuel's flammability giving an increased flexibility in storing the fuel. Additionally, the water content's heat of vaporization enhances the ability of the alcohol fuel to act as a knock suppressant. Further still, the water content can reduce the fuel's overall cost.

As a specific non-limiting example, the first fuel type in the first fuel tank may include gasoline and the second fuel type in the second fuel tank may include ethanol. As another non-limiting example, the first fuel type may include gasoline and the second fuel type may include a mixture of gasoline and ethanol. In still other examples, the first fuel type and the second fuel type may each include gasoline and ethanol, whereby the second fuel type includes a higher concentration of the ethanol component than the first fuel (e.g., E10 as the first fuel type and E85 as the second fuel type). As yet another example, the second fuel type may have a relatively higher octane rating than the first fuel type, thereby making the second fuel a more effective knock suppressant than the first fuel. It should be appreciated that these examples should be considered non-limiting as other suitable fuels may be used that have relatively different knock suppression characteristics. In still other examples, each of the first and second fuel tanks may store the same fuel. While the depicted example illustrates two fuel tanks with two different fuel types, it will be appreciated that in alternate embodiments, only a single fuel tank with a single type of fuel may be present.

Fuel tanks 202 and 212 may differ in their fuel storage capacities. In the depicted example, where second fuel tank 212 stores a fuel with a higher knock suppressant capability, second fuel tank 212 may have a smaller fuel storage capacity than first fuel tank 202. However, it should be appreciated that in alternate embodiments, fuel tanks 202 and 212 may have the same fuel storage capacity.

Fuel may be provided to fuel tanks 202 and 212 via respective fuel filling passages 204 and 214. In one example, where the fuel tanks store different fuel types, fuel filling passages 204 and 214 may include fuel identification markings for identifying the type of fuel that is to be provided to the corresponding fuel tank.

A first low pressure fuel pump (LPP) 208 in communication with first fuel tank 202 may be operated to supply the first type of fuel from the first fuel tank 202 to a first group of port injectors 242, via a first fuel passage 230. In one example, first fuel pump 208 may be an electrically-powered lower pressure fuel pump disposed at least partially within first fuel tank 202. Fuel lifted by first fuel pump 208 may be supplied at a lower pressure into a first fuel rail 240 coupled to one or more fuel injectors of first group of port injectors 242 (herein also referred to as first injector group). While first fuel rail 240 is shown dispensing fuel to four fuel injectors of first injector group 242, it will be appreciated that first fuel rail 240 may dispense fuel to any suitable number of fuel injectors. As one example, first fuel rail 240 may dispense fuel to one fuel injector of first injector group 242 for each cylinder of the engine. Note that in other examples, first fuel passage 230 may provide fuel to the fuel injectors of first injector group 242 via two or more fuel rails. For example, where the engine cylinders are configured in a V-type configuration, two fuel rails may be used to distribute fuel from the first fuel passage to each of the fuel injectors of the first injector group.

Direct injection fuel pump 228 that is included in second fuel passage 232 and may be supplied fuel via LPP 208 or LPP 218. In one example, direct injection fuel pump 228 may be an engine-driven, positive-displacement pump. Direct injection fuel pump 228 may be in communication with a group of direct injectors via a second fuel rail 250, and the group of port injectors 242 via a solenoid valve 236. Thus, lower pressure fuel lifted by first fuel pump 208 may be further pressurized by direct injection fuel pump 228 so as to supply higher pressure fuel for direct injection to second fuel rail 250 coupled to one or more direct fuel injectors 252 (herein also referred to as second injector group). In some examples, a fuel filter (not shown) may be disposed upstream of direct injection fuel pump 228 to remove particulates from the fuel. Further, in some examples a fuel pressure accumulator (not shown) may be coupled downstream of the fuel filter, between the low pressure pump and the high pressure pump.

A second low pressure fuel pump 218 in communication with second fuel tank 212 may be operated to supply the second type of fuel from the second fuel tank 202 to the direct injectors 252, via the second fuel passage 232. In this way, second fuel passage 232 fluidly couples each of the first fuel tank and the second fuel tank to the group of direct injectors. In one example, second fuel pump 218 may also be an electrically-powered low pressure fuel pump (LPP), disposed at least partially within second fuel tank 212. Thus, lower pressure fuel lifted by low pressure fuel pump 218 may be further pressurized by higher pressure fuel pump 228 so as to supply higher pressure fuel for direct injection to second fuel rail 250 coupled to one or more direct fuel injectors. In one example, second low pressure fuel pump 218 and direct injection fuel pump 228 can be operated to provide the second fuel type at a higher fuel pressure to second fuel rail 250 than the fuel pressure of the first fuel type that is provided to first fuel rail 240 by first low pressure fuel pump 208.

Fluid communication between first fuel passage 230 and second fuel passage 232 may be achieved through first and second bypass passages 224 and 234. Specifically, first bypass passage 224 may couple first fuel passage 230 to second fuel passage 232 upstream of direct injection fuel pump 228, while second bypass passage 234 may couple first fuel passage 230 to second fuel passage 232 downstream of direct injection fuel pump 228. One or more pressure relief valves may be included in the fuel passages and/or bypass passages to resist or inhibit fuel flow back into the fuel storage tanks. For example, a first pressure relief valve 226 may be provided in first bypass passage 224 to reduce or prevent back flow of fuel from second fuel passage 232 to first fuel passage 230 and first fuel tank 202. A second pressure relief valve 222 may be provided in second fuel passage 232 to reduce or prevent back flow of fuel from the first or second fuel passages into second fuel tank 212. In one example, lower pressure pumps 208 and 218 may have pressure relief valves integrated into the pumps. The integrated pressure relief valves may limit the pressure in the respective lift pump fuel lines. For example, a pressure relief valve integrated in first fuel pump 208 may limit the pressure that would otherwise be generated in first fuel rail 240 if solenoid valve 236 were (intentionally or unintentionally) open and while direct injection fuel pump 228 were pumping.

In some examples, the first and/or second bypass passages may also be used to transfer fuel between fuel tanks 202 and 212. Fuel transfer may be facilitated by the inclusion of additional check valves, pressure relief valves, solenoid valves, and/or pumps in the first or second bypass passage, for example, solenoid valve 236. In still other examples, one of the fuel storage tanks may be arranged at a higher elevation than the other fuel storage tank, whereby fuel may be transferred from the higher fuel storage tank to the lower fuel storage tank via one or more of the bypass passages. In this way, fuel may be transferred between fuel storage tanks by gravity without necessarily requiring a fuel pump to facilitate the fuel transfer.

The various components of fuel system 8 communicate with an engine control system, such as controller 12. For example, controller 12 may receive an indication of operating conditions from various sensors associated with fuel system 8 in addition to the sensors previously described with reference to FIG. 1. The various inputs may include, for example, an indication of an amount of fuel stored in each of fuel storage tanks 202 and 212 via fuel level sensors 206 and 216, respectively. Controller 12 may also receive an indication of fuel composition from one or more fuel composition sensors, in addition to, or as an alternative to, an indication of a fuel composition that is inferred from an exhaust gas sensor (such as sensor 128 of FIG. 1). For example, an indication of fuel composition of fuel stored in fuel storage tanks 202 and 212 may be provided by fuel composition sensors 210 and 220, respectively. Additionally or alternatively, one or more fuel composition sensors may be provided at any suitable location along the fuel passages between the fuel storage tanks and their respective fuel injector groups. For example, fuel composition sensor 238 may be provided at first fuel rail 240 or along first fuel passage 230, and/or fuel composition sensor 248 may be provided at second fuel rail 250 or along second fuel passage 232. As a non-limiting example, the fuel composition sensors can provide controller 12 with an indication of a concentration of a knock suppressing component contained in the fuel or an indication of an octane rating of the fuel. For example, one or more of the fuel composition sensors may provide an indication of an alcohol content of the fuel.

Note that the relative location of the fuel composition sensors within the fuel delivery system can provide different advantages. For example, sensors 238 and 248, arranged at the fuel rails or along the fuel passages coupling the fuel injectors with one or more fuel storage tanks, can provide an indication of a resulting fuel composition where two or more different fuels are combined before being delivered to the engine. In contrast, sensors 210 and 220 may provide an indication of the fuel composition at the fuel storage tanks, which may differ from the composition of the fuel actually delivered to the engine.

Controller 12 can also control the operation of each of fuel pumps 208, 218, and 228 to adjust an amount, pressure, flow rate, etc., of a fuel delivered to the engine. As one example, controller 12 can vary a pressure setting, a pump stroke amount, a pump duty cycle command and/or fuel flow rate of the fuel pumps to deliver fuel to different locations of the fuel system. A driver (not shown) electronically coupled to controller 12 may be used to send a control signal to each of the low pressure pumps, as required, to adjust the output (e.g. speed) of the respective low pressure pump. The amount of first or second fuel type that is delivered to the group of direct injectors via the direct injection pump may be adjusted by adjusting and coordinating the output of the first or second LPP and the direct injection pump. For example, the lower pressure fuel pump and the higher pressure fuel pump may be operated to maintain a prescribed fuel rail pressure. A fuel rail pressure sensor coupled to the second fuel rail may be configured to provide an estimate of the fuel pressure available at the group of direct injectors. Then, based on a difference between the estimated rail pressure and a desired rail pressure, the pump outputs may be adjusted. In one example, where the high pressure fuel pump is a volumetric displacement fuel pump, the controller may adjust a flow control valve of the high pressure pump to vary the effective pump volume of each pump stroke.

As such, while the direct injection fuel pump is operating, the high pressures in the compression chamber of the pump forces fluid into the piston-bore interface, thereby ensuring sufficient pump lubrication and a small cooling effect. However, during conditions when direct injection fuel pump operation is not requested, such as when no direct injection of fuel is requested, and/or when the fuel level in the second fuel tank 212 is below a threshold (that is, there is not enough knock-suppressing fuel available), the direct injection fuel pump may not be sufficiently lubricated if fuel flow through the pump is discontinued.

In alternate embodiments of fuel system 8 of FIG. 2, second fuel tank 212 may be eliminated such that fuel system 8 is a single fuel system with both port and direct fuel injection. Also, more than two fuels may be utilized in other embodiments. Additionally, in other examples, fuel may be supplied only to direct injectors 252 and port injectors 242 may be omitted. In this example system, low pressure fuel pump 208 supplies fuel to direct injection fuel pump 228 via bypass passage 224. Controller 12 adjusts the output of direct injection fuel pump 228 via adjusting a flow control valve of direct injection pump 228. Direct injection pump may stop providing fuel to fuel rail 250 during selected conditions such as during vehicle deceleration or while the vehicle is traveling downhill. Further, during vehicle deceleration or while the vehicle is traveling downhill, one or more direct fuel injectors 252 may be deactivated.

Figure 3:
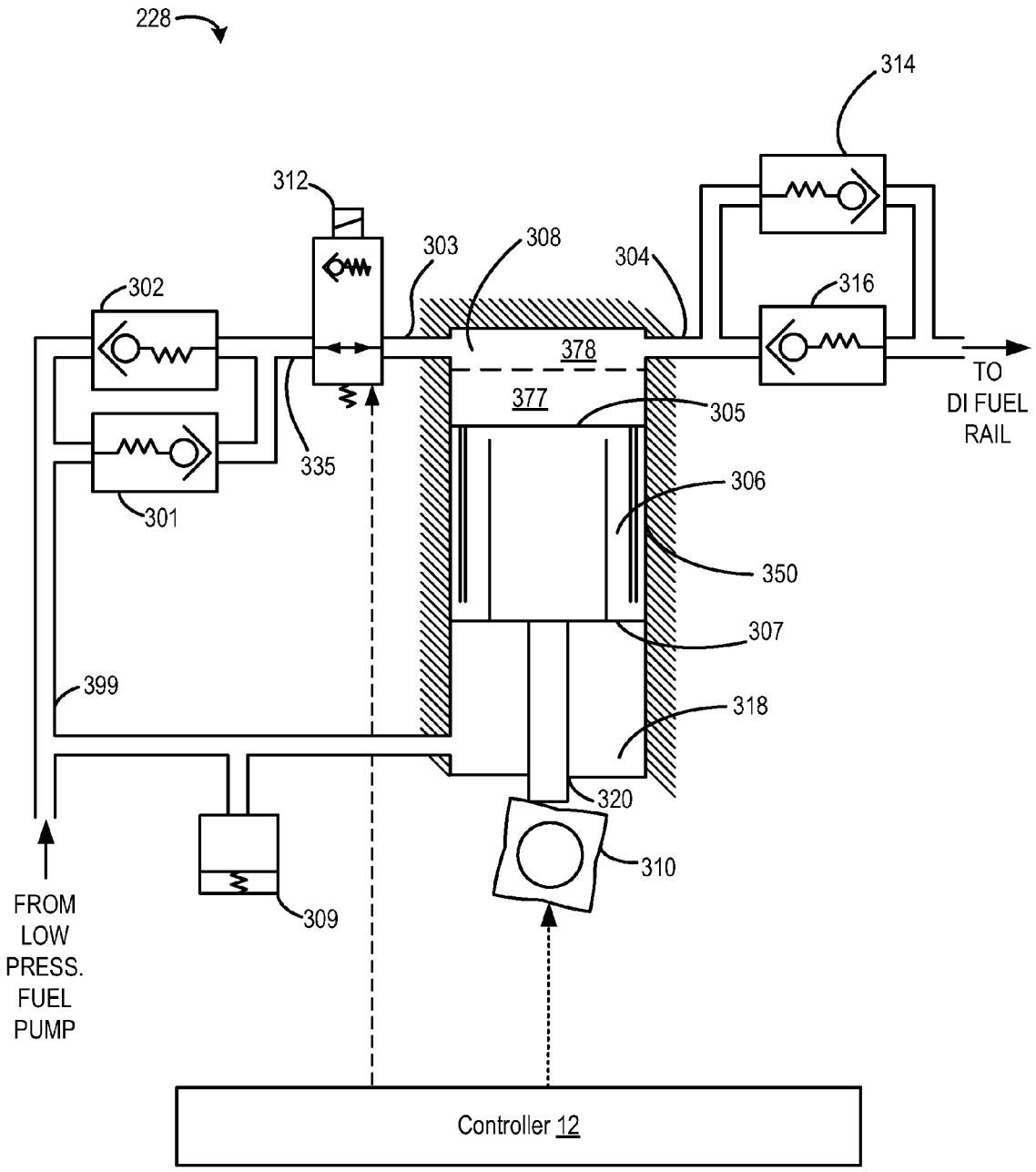
FIG. 3 shows an example of a high pressure direct injection fuel pump of the fuel system of FIG. 2.
Figure 4:
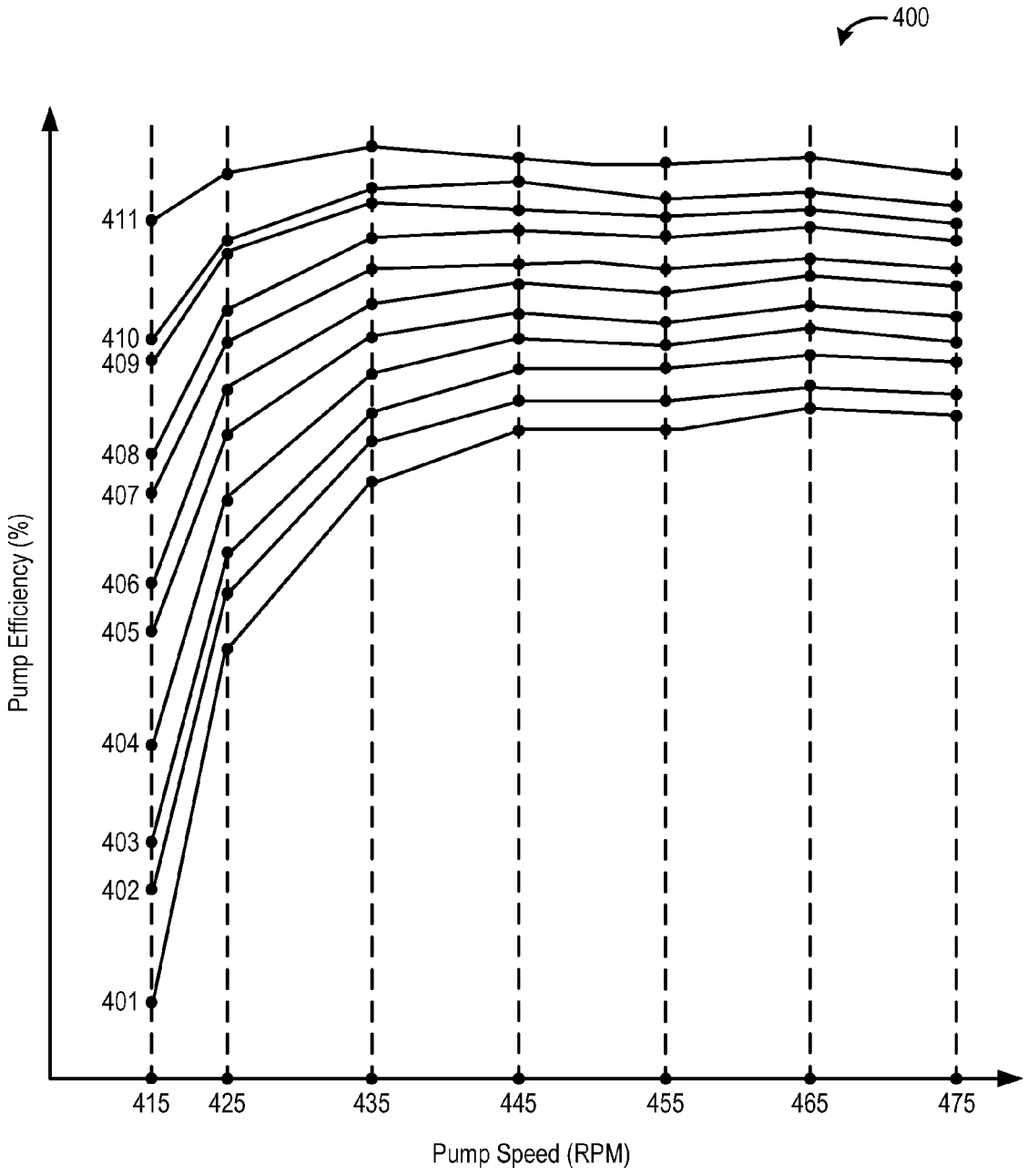
FIG. 4 depicts an example graphical mapping of a tested high pressure pump.

FIG. 3 shows an example embodiment of the direct injection fuel pump 228 shown in the system of FIG. 2. Inlet 303 of direct injection fuel pump compression chamber 308 is supplied fuel via a low pressure fuel pump as shown in FIG. 2. The fuel may be pressurized upon its passage through direct injection fuel pump 228 and supplied to a fuel rail through pump outlet 304. In the depicted example, direct injection pump 228 may be a mechanically-driven displacement pump that includes a pump piston 306 and piston rod 320, a pump compression chamber 308 (herein also referred to as compression chamber), and a step-room 318. A passage that connects step-room 318 to a pump inlet 399 may include an accumulator 309, wherein the passage allows fuel from the step-room to re-enter the low pressure line surrounding inlet 399. Assuming that piston 306 is at a bottom dead center (BDC) position in FIG. 3, the pump displacement may be represented as displacement 377. The displacement of the DI pump may be measured as the volume swept by piston 306 as it moves from top dead center (TDC) to BDC or vice versa. A second volume also exists within compression chamber 308, the second volume being a clearance volume 378 of the pump. The clearance volume defines the region in compression chamber 308 that remains when piston 306 is at TDC. In other words, the addition of volumes 377 and 378 form compression chamber 308. Piston 306 also includes a top 305 and a bottom 307. The step-room and compression chamber may include cavities positioned on opposing sides of the pump piston. In one example, engine controller 12 may be configured to drive the piston 306 in direct injection pump 228 by driving cam 310. Cam 310 includes four lobes and completes one rotation for every two engine crankshaft rotations.

A solenoid activated inlet check valve 312 may be coupled to pump inlet 303. Controller 12 may be configured to regulate fuel flow through inlet check valve 312 by energizing or de-energizing the solenoid valve (based on the solenoid valve configuration) in synchronism with the driving cam. Accordingly, solenoid activated inlet check valve 312 may be operated in two modes. In a first mode, solenoid activated check valve 312 is positioned within inlet 303 to limit (e.g. inhibit) the amount of fuel traveling upstream of the solenoid activated check valve 312. In comparison, in the second mode, solenoid activated check valve 312 is effectively disabled and fuel can travel upstream and downstream of inlet check valve.

As such, solenoid activated check valve 312 may be configured to regulate the mass (or volume) of fuel compressed into the direct injection fuel pump. In one example, controller 12 may adjust a closing timing of the solenoid activated check valve to regulate the mass of fuel compressed. For example, a late inlet check valve closing may reduce the amount of fuel mass ingested into the compression chamber 308. The solenoid activated check valve opening and closing timings may be coordinated with respect to stroke timings of the direct injection fuel pump.

Pump inlet 399 allows fuel to check valve 302 and pressure relief valve 301. Check valve 302 is positioned upstream of solenoid activated check valve 312 along passage 335. Check valve 302 is biased to prevent fuel flow out of solenoid activated check valve 312 and into pump inlet 399. Check valve 302 allows flow from the low pressure fuel pump to solenoid activated check valve 312. Check valve 302 is coupled in parallel with pressure relief valve 301. Pressure relief valve 301 allows fuel flow (or other fluid flow) through solenoid activated check valve 312 toward the low pressure fuel pump when pressure between pressure relief valve 301 and solenoid operated check valve 312 is greater than a predetermined pressure (e.g., 10 bar). When solenoid operated check valve 312 is deactivated (e.g., not electrically energized), solenoid operated check valve operates in a pass-through mode and pressure relief valve 301 regulates pressure in compression chamber 308 to the single pressure relief setting of pressure relief valve 301 (e.g., 15 bar). Regulating the pressure in compression chamber 308 allows a pressure differential to form from piston top 305 to piston bottom 307. The pressure in step-room 318 is at the pressure of the outlet of the low pressure pump (e.g., 5 bar) while the pressure at piston top is at pressure relief valve regulation pressure (e.g., 15 bar). The pressure differential allows fuel to seep from piston top 305 to piston bottom 307 through the clearance between piston 306 and pump cylinder wall 350, thereby lubricating direct injection fuel pump 228. The seepage of fuel from piston top 305 (adjacent to compression chamber 308) to piston bottom 307 (adjacent to step-room 318) may hereafter be referred to as normal piston-bore interface leak, where cylinder wall 350 may define the bore and the interface is the adjacent area of wall 350 and piston 306. The normal piston-bore interface leak may be equal to or less than a threshold amount of leakage that may be beneficial to pump lubrication. The normalcy of the leak is due to the design of DI pump 228 in order to ensure adequate lubrication. Furthermore, the leak may aid in decreasing the amount of wear that occurs between the piston and the bore. The volumetric rate (or amount) of fuel that passes through the piston-bore interface (the normal leak) may vary between pump and fuel systems depending a number of factors, including pump size, desired fuel rail pressure, type of fuel, and geometry of the fuel lines. In other words, the threshold amount of leakage that defines the normal-piston-bore interface leak may be a function of the aforementioned factors.

Piston 306 reciprocates up and down within compression chamber 308. Direct fuel injection pump 228 is in a compression stroke when piston 306 is traveling in a direction that reduces the volume of compression chamber 308. Direct fuel injection pump 228 is in a suction stroke when piston 306 is traveling in a direction that increases the volume of compression chamber 308.

A forward flow outlet check valve 316 may be coupled downstream of an outlet 304 of the compression chamber 308. Outlet check valve 316 opens to allow fuel to flow from the compression chamber outlet 304 into a fuel rail only when a pressure at the outlet of direct injection fuel pump 228 (e.g., a compression chamber outlet pressure) is higher than the fuel rail pressure. Thus, during conditions when direct injection fuel pump operation is not requested, controller 12 may deactivate solenoid activated inlet check valve 312 and pressure relief valve 301 regulates pressure in compression chamber to a single substantially constant (e.g., regulation pressure ±0.5 bar) pressure during most of the compression stroke. On the intake stroke the pressure in compression chamber 308 drops to a pressure near the pressure of the lift pump (208 and/or 218). Lubrication of DI pump 228 may occur when the pressure in compression chamber 308 exceeds the pressure in step-room 318. This difference in pressures may also contribute to pump lubrication when controller 12 deactivates solenoid activated check valve 312. One result of this regulation method is that the fuel rail is regulated to a minimum pressure approximately the pressure relief of 302. Thus, if valve 302 has a pressure relief setting of 10 bar, the fuel rail pressure becomes 15 bar because this 10 bar adds to the 5 bar of lift pump pressure. Specifically, the fuel pressure in compression chamber 308 is regulated during the compression stroke of direct injection fuel pump 228. Thus, during at least the compression stroke of direct injection fuel pump 228, lubrication is provided to the pump. When direct fuel injection pump enters a suction stroke, fuel pressure in the compression chamber may be reduced while still some level of lubrication may be provided as long as the pressure differential remains. Another check valve 314 (pressure relief valve) may be placed in parallel with check valve 316. Valve 314 allows fuel flow out of the DI fuel rail toward pump outlet 304 when the fuel rail pressure is greater than a predetermined pressure.

It is noted here that DI pump 228 of FIG. 3 is presented as an illustrative example of one possible configuration for a DI pump. Components shown in FIG. 3 may be removed and/or changed while additional components not presently shown may be added to pump 228 while still maintaining the ability to deliver high-pressure fuel to a direct injection fuel rail. As an example, pressure relief valve 301 and check valve 302 may be removed in other embodiments of fuel pump 228. Furthermore, the methods presented hereafter may be applied to various configurations of pump 228 along with various configurations of fuel system 8 of FIG. 2.

A factor that may be considered while designing fuel systems for vehicles is the performance of the direct injection pump, such as pump 228 shown in FIGS. 2 and 3. Pump performance characteristics may be useful in a number of ways, including predicting the behavior of the DI pump during different operating conditions. Pump performance may be quantified in the form of tabulated values or a graph, known as a pump performance model. These models may be designed and manipulated through variables and constants in order to closely align with the reality of a pump, in this case a direct injection fuel pump. In this context, the reality of the pump refers to the data gathered from pump testing, where pumps are run for a period of time while varying one or more parameters. To reiterate, when equations and other physics-based parameters are used to quantify the performance of a pump, the data may be compiled in a pump performance model, such as during a calibration phase. On the other hand, a pump mapping may be created from the physical, real data gained from testing a pump and measuring/recording outputs of the pump. The utility of pump performance models, described in more detail later, may be to closely reflect pump mappings in order to compare ideal or expected pump behavior to actual pump behavior.

As an example for retrieving pump data for a pump mapping, a pump may be run at increasing speed measured in revolutions per minute (RPM), a variable which may be presented in graphical form as a horizontal axis. Additionally, while pump speed is increasing, a fuel rail pressure may be held at a constant value. Since pump speed increases due to the rotational speed of drive cam 310, engine speed may also be increasing simultaneously. While pump speed continuously or otherwise increases, a responsive parameter may be continuously measured, in this case a fractional volume of liquid fuel pumped through the DI pump and out of compression chamber 308. The fractional volume of liquid fuel pumped may be presented graphically as a vertical axis. The fractional volume of liquid fuel pumped may be the ratio between actual fuel volume pumped and an ideal fuel volume pumped. Fractions may be more useful when comparing pump characteristics between different DI pumps that may pump different fuel quantities. Next, the fuel rail pressure may be increased and the pump again increased through a speed range while fractional liquid volume pumped is again recorded. This method may produce a number of curves that can be presented on a common graph. It is noted that during this measurement process, the solenoid activated inlet check valve 312 may close (is energized) coincident with the beginning of the compression stroke of pump piston 306, which means the volume of fuel drawn into compression chamber 308 cannot escape backward into passage 335. This closing timing may also be referred to as a 100% pump duty cycle. The solenoid valve energizing may be necessary to accurately map the DI pump.

FIG. 4 shows an example pump mapping 400 that shows pump speed as the horizontal axis and pump efficiency as the vertical axis. Pump efficiency may be equivalent to fractional liquid fuel volume pumped in that both represent how much fuel is actually pumped into the fuel rail compared to how much fuel is ideally pumped into the fuel rail. For example, a pump efficiency of 50% corresponds to 0.5 fractional liquid volume pumped, meaning that half of the fuel compressed in compression chamber 308 was sent into the fuel rail (downstream of pump outlet 304). FIG. 4 contains eleven individual curves 401-411, each corresponding to a performance curve of the DI pump at a constant fuel rail pressure. Generally, the fuel rail pressure increases with each lower curve. For example, curve 411 may correspond to a fuel rail pressure of 2 MPa while curve 401 may correspond to a fuel rail pressure of 16 MPa. Curves 401-411 may be formed by measuring a series of data points as previously described. In FIG. 4, data is taken at a series of pump speeds 415, 425, 435, 445, 455, 465, and 475. For example, speed 415 may be 250 RPM while speed 445 may be 1500 RPM and speed 475 may be 3000 RPM. As seen, the data points that form each curve 401-411 lie along the same pump speeds 415-575, but it is noted that those points may be located at any pump speed.

In FIG. 4 there is a distinction between the leftmost side of mapping 400 (lower pump speeds) and right side of mapping 400 (higher pump speeds). Approximately to the left of speed 435, which may be 1000 RPM, pump efficiency drastically decreases. To the right of speed 435, the efficiencies associated with curves 401-411 remain roughly constant and only slightly vary as compared to the efficiencies to the left of speed 435. This feature will be later described in more detail.

As seen by mapping 400, identifying the source of lower pump efficiencies may be useful in fixing DI pump problems and/or adjusting operating parameters of the pump to achieve better overall performance. Although mapping 400 may be advantageous to quantify pump characteristics, a thorough mapping may not be able to be performed on-board a vehicle during normal operation since pump operation may be determined by varying engine requirements. As such, a pump performance model may instead be stored on-board a vehicle for use in quantifying pump efficiency and/or identifying issues with the DI pump. With a pump performance model, variables such as fuel rail pressure and pump speed may be inputted and the pump performance model may output a pump efficiency (fractional fuel volume pumped). The pump efficiency may be converted into an actual fuel volume pumped by multiplying by displacement of the pump piston. The displacement of the pump piston may be the ideal pumped fuel volume. In this way, while the modeled actual fuel volume pumped is calculated on-board the vehicle by a device such as controller 12, the measured actual fuel volume pumped from the DI pump may be measured by a sensor. Finally, the modeled actual fuel volume pumped and measured actual fuel volume pumped may be compared. From the comparison, if there is a large discrepancy between the two values, then an issue may exist in the DI pump.

Performance of the DI pump may be useful to identify possible sources of pump inefficiencies and/or issues, and those issues may be corrected to increase pump efficiency and enable better overall vehicle performance. For one example issue, excessive fuel may be lost from the DI pump in addition to the normal pump-bore interface leak as mentioned previously. This excessive loss of fuel may be at least partially caused by wear between the piston and bore (cylinder wall 350). As wear, or material abrasion and/or removal, occurs between the piston and bore, the gap between the two may increase, which may cause more fuel than the normal quantity to escape compression chamber 308 and enter step room 318, or the backside of the pump. The excessive loss of fuel, that is, a volume of fuel that is forced past the piston-bore interface in addition to the normal leak, is hereafter referred to as abnormal piston-bore interface leak (abnormal leak). The abnormal piston-bore interface leak may be higher than the aforementioned threshold amount of leakage.

The inventors herein have recognized that other diagnostic methods for determining when abnormal leak occurs may have poor signal-to-noise ratios which may lead to inaccurate results. Furthermore, other diagnostic methods may be based on pump performance models that may not accurately reflect reality (a pump mapping). In addition, the models may not be sufficiently calibrated for various pump conditions such as expected degradation due to prolonged use of the pump, which may also be referred to as pump aging. As such, the inventors herein have proposed a DI pump bore wear detection method, or a diagnostic function, that may yield results that can be used to identify abnormal piston-bore interface leak (caused by bore wear) that can be later fixed. The proposed detection method is based on a physics-based pump performance model that incorporates a number of factors and is shown to more closely align with the reality of a pump mapping, as described in more detail below.

A pump performance model may include any number of variables and/or constants which may be manipulated to better reflect the reality of how a DI pump operates. As one example, the inventors herein have proposed a pump model that involves two physical effects along with an extra constant that may contribute to pumping less fuel than the ideal amount. One of the physical effects may be the lost pumped volume due to the bulk modulus of the fuel and the size of the compression chamber's clearance volume 378, which may also be referred to as the pump's dead volume. The fuel's bulk modulus is a measure of the fuel's resistance to uniform compression, which may also be thought of as a measure of the fuel's compressibility. As the size of clearance volume 378 changes along with the fuel's bulk modulus, the amount of fuel ejected into the fuel rail may be correspondingly affected. In some fuel systems, as clearance volume 378 increases, HP pump effectiveness (i.e., efficiency) may decrease. In particular, the first physical effect (clearance volume and bulk modulus) may result in lost fuel mass as a function of FRP.

The second physical effect may be the lost pumped volume due to the normal leak rate through the piston-bore interface, earlier described and referred to as normal piston-bore interface leak. Again, this normal leak may be necessary to ensure pump lubrication. The rate of the leak, that is, how fast fuel is expelled through the piston-bore interface, may depend on pressure in compression chamber 308 as well as how long elevated pressure is maintained in the compression chamber, known as the time-at-pressure. The time-at-pressure may at least partially depend on the energizing timing of solenoid activated inlet check valve 312. In particular, the second physical effect (normal fuel leak) may result in lost fuel mass as a function of both FRP and time available for leaking, which may be represented as the reciprocal of engine speed, or 1/RPM. Finally, the extra constant may be a miscellaneous cause, which may include additional sources of lost pumped volume such as displaced volume during closing of the inlet check valve of solenoid valve 312 and/or closing of the check valves at the outlet of the DI fuel pump. The fuel loss due to check valve displacement may also be referred to as fuel loss due to check valve swept area. The miscellaneous cause may be a constant value independent of variables such as engine speed and FRP.

With the factors that contribute to the pump performance model (two physical effects and the constant), an equation may be defined based on three values, each of which are associated with the three factors. The numerical values presented below are based on repeated evaluation and comparison between the pump performance model and a mapped DI pump. It is understood that the values presented below may be different while exemplifying the same general concept of this physics-based pump performance model.

For the below equations, FRP=fuel rail pressure (MPa), N=engine speed (RPM), DC=duty cycle or energizing timing of the solenoid activated inlet check valve, and D=pump displacement (cc). The first value, FV1=fractional lost volume 1, quantifies the miscellaneous cause and may be a constant value such as 0.02.

The second value, FV2=fractional lost volume 2, quantifies the bulk modulus of the fuel and size of the clearance volume, and is a function of fuel rail pressure. This value can be rewritten as FV2=0.0045*FRP.

The third value, FV3=fractional lost volume 3, quantifies the normal piston-bore interface leak, and is a function of engine speed, fuel rail pressure, and duty cycle. This value can be rewritten as 5*N/(FRP*DC). In other embodiments, FV3 may be dependent on only engine speed and FRP while excluding dependence on pump duty cycle.

Now that the three values have been quantitatively defined, each incorporating the factors as previously described, the total lost fractional volume of liquid fuel may be represented as: FV_T=total lost fractional volume=FV1+FV2+FV3. Conversely, the fraction of liquid fuel volume pumped may be represented as: PV=fractional pumped volume=1−FV_T. To convert between total fractional volume pumped and volume pumped per piston stroke, the following equation may be used: VP=volume pumped per stroke=D*PV=target pump rate. The target pump rate is the volume of fuel pumped through the DI pump based on the pump performance model, where a normal piston-bore interface leak is present. As described later, the target pump rate may be compared with other values to determine whether or not abnormal piston-bore interface leak may be present. In summary, in this example the pump performance model may be calculated based on fuel loss due to bulk modulus of the fuel and the dead volume of the pump compression chamber, normal leak through the piston-bore interface, and the miscellaneous cause.

Notice that three constants are employed in the total lost fractional volume equation (FV_T), where the three constants are 0.02, 0.0045, and 5, each associated with one of the three values FV1, FV2, and FV3, respectively. As is standard practice with other models that attempt to replicate data gained from testing, the three constants may be changed to better fit the mapped pump curves, such as those shown in FIG. 4. The values given here for the three constants may change depending on the particular pump, fuel, and engine systems.

It is noted that the above pump performance model based on the two physical effects and miscellaneous cause may be one of multiple possible pump performance models. In another possible model, different constants may be associated with the two physical effects and miscellaneous cause, different than the 0.02, 0.0045, and 5 values. Furthermore, the physical effects may be found to be dependent on additional variables such as temperature or fuel composition. In another example, a third physical effect may be lost pumped fuel volume due to fuel flow restrictions through the DI pump and attached fuel rail. At high flow rates, significant fuel displacement loss may occur as a result of restrictions present in the pump and attached fuel system components. The third physical effect (restriction) may result in lost fuel mass as a function of the square of fuel flow rate and fuel mass pumped. This third physical effect may be included in the above FV_T equation and quantified as fractional lost volume 4, or FV4. Extending this concept, it can be seen that additional physical effects may be included when other causes of fuel loss are found. For example, other physical effects may be temperature and elevation.

In this way, additional pump performance models may be implemented with the method for detecting abnormal piston-bore interface fuel leak (as described later) without departing from the scope of the present disclosure. The above pump performance model involving FV1, FV2, and FV3 is one example of many possible pump performance models. Although individual pump models may involve different physical effects and other parameters, they may share the common objective of attempting to closely match the reality of the operation of the DI pump quantified by the DI pump mapping. As explained in further detail below, accurate pump performance models may be used to compare expected pump operation to actual pump operation in order to detect malfunctions such as abnormal piston-bore interface fuel leakage.

Figure 5A:
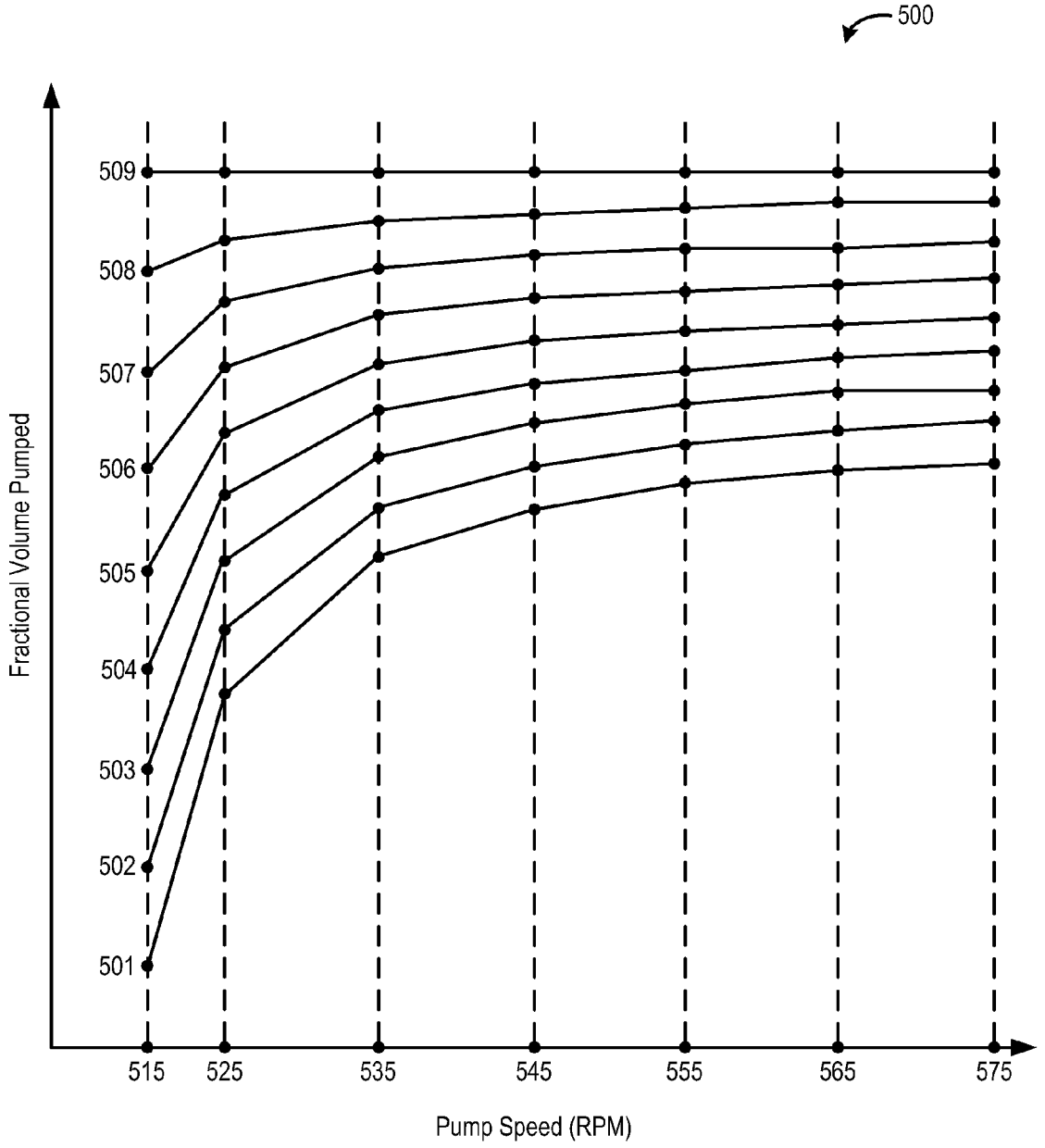
FIG. 5A depicts a graphical representation of an example pump performance model, which can be compared to the mapping of FIG. 4.
Figure 5B:
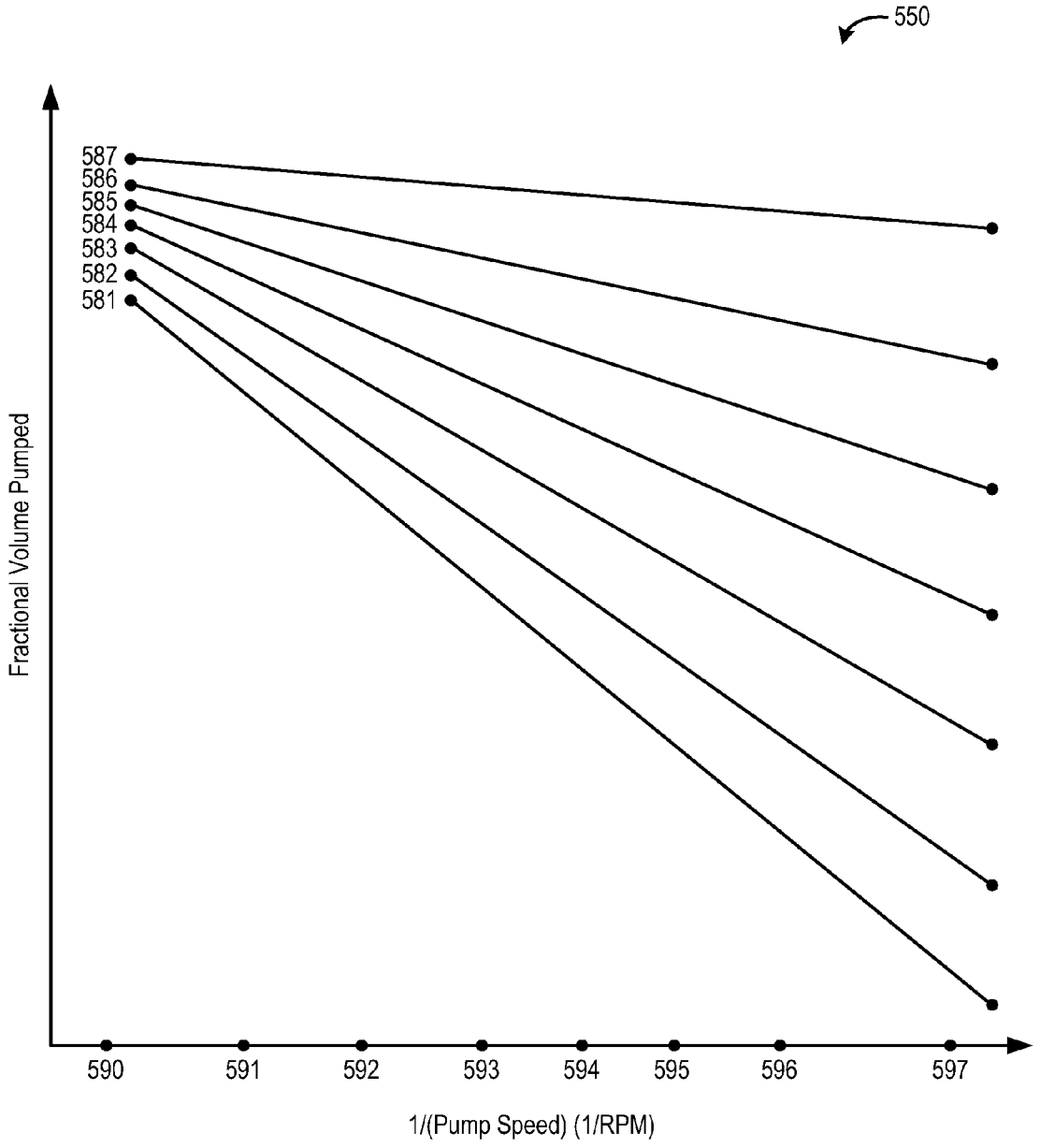
FIG. 5B depicts a plot of a mapping or a pump performance model on an alternative axis.

FIG. 5A shows pump performance model 500 in a graphical form. In FIG. 5A, numbers are given to the variables of the fractional pumped volume equation (PV=1−FV_T) to form curves 501-509. FIG. 5A shares many features similar to those shown in FIG. 4. Each individual curve 501-509 may correspond to a constant fuel rail pressure. For example, curve 509 may correspond to a fuel rail pressure of 0 MPa while curve 501 may correspond to a fuel rail pressure of 16 MPa. Each data point of FIG. 5A lies along a vertical line of pump speeds 515, 525, 535, 545, 555, 565, and 575. For example, speed 515 may be 250 RPM while speed 545 may be 1500 RPM and speed 575 may be 3000 RPM. It is noted here that in this case engine speed is twice as fast as a given pump speed. For example, pump speed 535 may be 1000 RPM while the corresponding engine speed may be 2000 RPM. Furthermore, for each curve shown in the graph of pump performance model 500, the solenoid activated inlet check valve 312 may close (is energized) coincident with the beginning of the compression stroke of pump piston 306, also known as a 100% duty cycle, in the same manner as described while taking measurements for a pump mapping. As such, numerically, duty cycle (DC) is equal to 1 in the fractional pumped volume equation. In this way, a comparison can be made between pump mapping 400 of FIG. 4 and the graph of the pump performance model 500 of FIG. 5A.

The same behavior as described with regard to FIG. 4 is displayed in FIG. 5A, wherein the leftmost side of the graphs exhibit lower efficiencies (or fractional volumes pumped) than the right side of the graphs. Physically, this suggests that the HP pump may perform with lower efficiencies at lower speeds. Furthermore, this suggests that the HP pump may maintain the best performance when it operates at higher speeds while supplying lower pressures to the fuel rail (upper-right corner of plots 400 and 500). Additionally, the general shape of curves 401-411 and 501-509 are similar. This similarity between the curves of FIGS. 4 and 5 may demonstrate that the aforementioned physics-based pump performance model 500 that involves two physical effects and an extra constant is an accurate representation of the real behavior of the DI pump as quantified by mapping 400. It is understood that the comparison between the model and mapping may only be applicable when both methods (400 and 500) for determining pump efficiency refer to the same direct injection pump with a specified clearance volume and displacement. Furthermore, the direct comparison between mapping 400 and model 500 may only be relevant when both methods utilize an energized solenoid activated check valve coincident with the beginning of the compression stroke, or a duty cycle of 100%.

It is noted that pump mapping 400 of FIG. 4 and pump performance model 500 of FIG. 5A may be plotted in a slightly different way than the plots shown in FIGS. 4 and 5. Turning to FIG. 5B, an alternative plotting of graph 550 is shown. It is understood that graph 550 may be a mapping of the HP pump or a graphical representation of a pump performance model. The vertical axis of FIG. 5B is fractional volume pumped, the same as the vertical axis of FIG. 5A. In other examples, the vertical axis may also be labeled as pump efficiency which is equivalent to fractional volume pumped, as previously explained. The horizontal axis, rather than being pump speed measured in RPM, is the reciprocal of pump speed with units of 1/RPM. Each individual line 581-587 of graph 550 may correspond to a constant fuel rail pressure. For example, line 587 may correspond to a fuel rail pressure of 2 MPa while line 581 may correspond to a fuel rail pressure of 14 MPa. A series of reciprocated pump speeds lie along the horizontal axis, including reciprocated speeds 590, 591, 592, 593, 594, 595, 596, and 597. For example, reciprocated speed 590 may be 6000 1/RPM while speed 593 may be 600 1/RPM and speed 597 may be 200 1/RPM. Furthermore, for each line shown in graph 500, the solenoid activated inlet check valve 312 may close (is energized) coincident with the beginning of the compression stroke of pump piston 306, also known as a 100% duty cycle, in the same manner as described with regard to FIGS. 4 and 5B. As such, numerically, duty cycle (DC) is equal to 1 in the fractional pumped volume equation. Notice that lines 581-587 are linear whereas curves 401-411 of FIG. 4 and 501-509 of FIG. 5A are nonlinear. Furthermore, if the pump speed data of each data point of curves 401-411 and 501-509 were reciprocated to reflect units of 1/RPM and plotted with the horizontal axis of 1/RPM, then curves 401-411 and 501-509 may be substantially straight lines similar to lines 581-587. In this way, the linearity of lines 501-509 may provide simpler representation of a pump mapping or a pump performance model in addition to providing characteristics relevant to the physics of HP pumps.

With an understanding of the aforementioned physics-based pump performance model, the proposed DI pump bore wear detection method is presently described. As previously mentioned, the utility of a pump performance model is that it may be stored in a controller such as controller 12 on-board a vehicle for use during normal pump operation. In an equivalent sense, the physics-based pump performance model may be utilized during normal engine operation.

As such, the inventors herein have proposed a DI pump bore wear detection method, or a diagnostic function, that may yield results that can be used to identify abnormal piston-bore interface leak (caused by bore wear) that can be later fixed. The first step in diagnosing whether abnormal piston-bore interface leakage is present may be to analyze pump performance during one or more predetermined situations. The predetermined situations may include a manual operator command such as by a service technician, a specified number of times throughout a time period, or every time an engine condition is met. Next, a series of measurements may be recorded by one or more sensors on a vehicle to form a series of data. Then, that series of data may be compared to the physics-based pump performance model. If a discrepancy above a threshold is detected, then an error may be issued that diagnoses the piston-bore interface as abnormally leaking, and therefore wear has occurred between the piston and cylinder wall of the DI pump. With the issued error stored in the vehicle, a service technician and/or operator of the vehicle may be made aware of the abnormal leak and reparative action may be taken, such as replacing pump components.

The physics-based pump performance model may be generated during a calibration phase, which may occur during testing of a high pressure pump prior to installing it in a vehicle. The model may then be later programmed into the vehicle controller's memory. The calibration phase could occur during a research and development stage of a vehicle system, wherein various components are tested as potential candidates for installation in the final vehicle. Once the high pressure pump is located inside the vehicle and the vehicle is being driven by an operator (customer), then the pump bore wear detection method may be initiated according to the predetermined situations. During execution of the bore wear detection method, the pump performance model may be available for generating pumping data.

Figure 6:
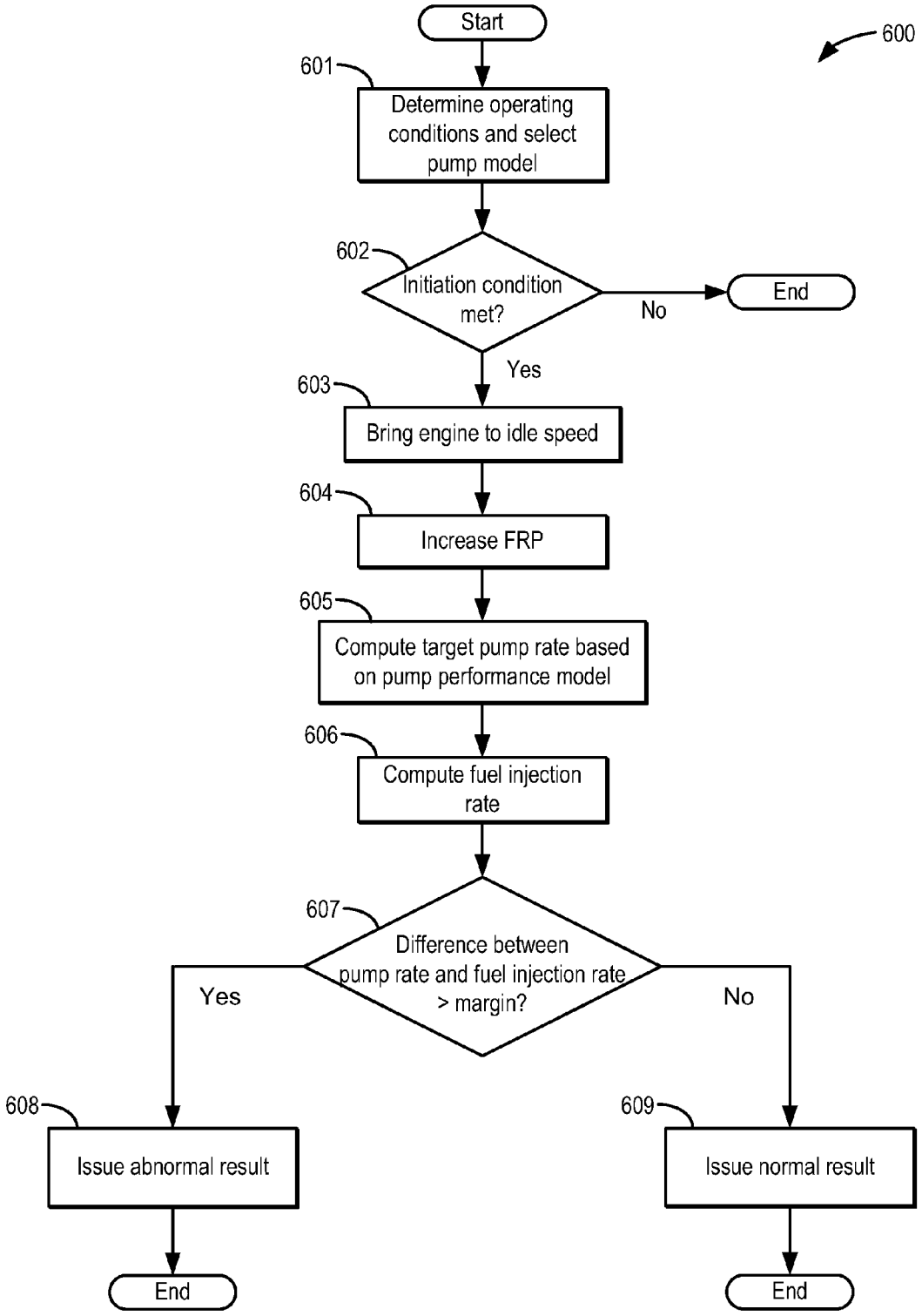
FIG. 6 depicts a flow chart of a bore wear detection method that may alert a user of an abnormal piston-bore interface leak.

FIG. 6 shows a flow chart for an example DI pump bore wear detection method 600. Detection method 600 may be performed on-board the vehicle. First, at 601, a number of operating conditions may be determined. These include, for example, engine speed, ambient air conditions, fuel composition and temperature, selecting one or more initiation conditions, selecting a threshold fuel rail pressure as explained below, engine fuel demand, engine temperature, etc. Upon determining the conditions, a specific physics-based performance model may be selected, such as model 500 as previously described. At 602, based on the engine operating conditions and selected pump performance model, it may be determined if initiation conditions have been met. The initiation conditions may include, for example, receiving an input indicative of a starting command from a person such as a service technician during maintenance of the vehicle, receiving an automatic starting command by an engine controller, or issuing the starting command every time the engine enters an idling condition, or other similar conditions. If the initiation conditions of 602 are not satisfied, then the process ends and engine operation without performing a pump bore leak diagnostic may resume. Conversely, if any or all of the initiation conditions are confirmed, then at 603 the leak detection diagnostic routine may proceed and the engine is brought to an idling speed. Throughout each subsequent step beyond 603, the engine remains at the idling speed and if the engine exhibits a speed outside the idling speed, then method 600 may be terminated.

Next, at 604, while the idling engine speed is maintained, pressure is increased in a direct injection fuel rail of the engine to a threshold fuel rail pressure. The threshold fuel rail pressure may be a FRP at which the DI pump is most susceptible to abnormal leakage. For example, a higher value for the threshold FRP may create a larger pressure differential between the top and bottom of the DI pump, thereby forcing more fuel through the piston-bore interface. Upon reaching the threshold fuel rail pressure, at 605 a target pump rate of the HP pump may be computed based on a pump performance model. In this step, the previously described physics-based pump performance model may be used with the equation for the total lost fractional volume (FV_T). Several variables may be inserted into the equation of the total lost fractional volume, including but not limited to engine speed, fuel rail pressure, and pump duty cycle. These values may be measured by one or more sensors of the engine. From the lost volume equation (FV_T), the target pump rate may be calculated. The target pump rate represents the volume of fuel that is expected to be pumped by the DI pump based on the pump performance model, including the normal piston-bore interface leak. The pump performance model may be stored in and calculated by a controller with computer readable instructions stored in non-transitory memory, such as controller 12, and the controller may be located on-board a vehicle with the engine, such as engine 10.

Next, at 606, a fuel injection rate may be estimated or computed, where the fuel injection rate is the amount of fuel being injected into the cylinders of the engine. Again, one or more sensors of the engine may measure the parameters necessary to compute the fuel injection rate. At 607, a comparison may be made between the target pump rate and the estimated fuel injection rate. To reiterate, the target pump rate can be regarded as the expected volume of fuel pumped by the DI pump, whereas the fuel injection rate can be regarded as the actual volume of fuel injected, which directly corresponds to the actual volume of fuel pumped by the DI pump since the DI pump is fluidly coupled to the fuel rail (and injectors) as seen in FIG. 3. Also, a margin may be defined that includes a value of uncertainty that may be based on the degree of accuracy of the pump performance model. As an example, if the pump performance model does not align with the mapped pump, then a larger margin may be assigned than if the performance model were closely-aligned with the mapped pump. The value of uncertainty may reduce the occurrence of erroneous pump-bore interface leak results.

Upon completion of the comparison, a piston-bore interface leak result may be issued that is based on the comparison between the expected volume of fuel pumped by the DI pump (based on the model) and the actual estimated volume of fuel pumped by the DI pump. If the comparison in step 607 determines that the target pump rate is higher than the fuel injection rate by more than the margin, pump degradation is determined. In particular, a piston-bore interface leak is diagnosed as abnormal at step 608. In other words, since the fuel injection rate is lower than the target pump rate by more than a margin, then more fuel than expected may be escaping the compression chamber, signifying an abnormal piston-bore interface leak caused by bore wear. Herein, in response to the target pump rate being larger than the fuel injection rate by more than a margin, it may be determined that more than a threshold amount of fuel is leaking from the pump compression chamber into the step room of the pump. Conversely, if the comparison in step 607 determines that the target pump rate is equal to or lower than the fuel injection rate plus the margin, then the piston-bore interface leak result is normal at step 609. In other words, since the fuel injection rate is close to (as determined by the margin) or higher than the target pump rate, then a normal amount of fuel may be escaping the compression chamber, signifying a normal piston-bore interface leak and an absence of excessive bore wear. Furthermore, the amount of fuel leakage corresponding to the normal piston-bore interface leak result may lubricate the high pressure fuel pump. Herein, in response to the target pump rate being less than the fuel injection rate plus a margin, it may be determined that less than a threshold amount of fuel is leaking from the compression chamber into the step room of the DI pump.

It is noted that steps 604-607 and 608 or 609 may be completed only during an engine idling speed as set in step 603. For example, if idling speed were present while computing the target pump rate at step 605, but when the fuel injection rate is being computed (from data gathered by engine sensors) at step 606, if the engine speed were to increase outside an idling speed range, then method 600 would be aborted and no subsequent steps would be completed. Furthermore, a leak result would not be issued in this situation. Only during engine idling speed may the bore wear detection method 600 be fully completed. If engine idling speed is not present during or in between any of steps 604-607 and 608 or 609, then detection method 600 is aborted. In alternative embodiments, step 603 may include bringing the engine into a different operating condition than idling. For example, detection method 600 may also be performed when the engine is slowly cranking at 603 and subsequently in steps 604-608 or 604-609. In other examples, an engine starting sequence may be commanded at 603. Depending on the particular fuel and engine systems, different engine operating conditions may be commanded at 603 to increase susceptibility to abnormal piston-bore interface leak in order to issue a correct result as determined in 607.

In the case where an abnormal piston-bore interface leak result is issued, an operator or technician may be made aware of the abnormal leak and action may be taken to fix the abnormal leak. For example, in response to determination of more than a threshold amount of fuel leaking from the bore, a diagnostic code may be set and/or a malfunction indication light may be set. Fixing procedures may include replacing DI pump components and adjusting operating commands of the high pressure pump to adjust its pumping characteristics. In this way, bore wear detection method 600 enables the possible presence of abnormal leak to be periodically evaluated and if wear is detected, the leak may be addressed in a timely manner.

In some embodiments, method 600 may be executed concurrently with other fuel system diagnostics. For example, method 600 may be initiated with a fuel injector diagnostic which may also utilize increased fuel rail pressure and prediction of fuel flow or fuel injection rate. While the fuel injector diagnostic may determine if the fuel injectors such as injectors 242 and 252 are operating without fault, the pump bore wear detection method 600 may determine if a normal or abnormal amount of fuel is leaking through the pump-bore interface by comparing the pump rate of a pump performance model to the actual, measured fuel injection rate. Furthermore, at step 606, method 600 may include gathering data from the fuel injector diagnostic in order to calculate the fuel injection rate. During method 600, the HP pump may be operated at a lower speed as determined by the engine idling condition. Alternatively, during normal operation of the HP pump, higher speeds may be commanded by the vehicle operator, which may postpone execution of method 600.

In this way, a bore wear detection method is provided that may reliably determine the presence of piston-bore interface leakage in a number of ways. First, the proposed bore wear detection method is based on a pump performance model (FIG. 5A) that was shown to exhibit behavior that is similar to the actual mapped pump data (FIG. 4). Therefore, the pump performance model may be used to output target pump rates that may more accurately match the real values that are expected from the HP pump. Furthermore, depending on the initial condition, the bore detection method may be performed during a variety of situations that are conducive to the operation of the vehicle. For example, conducting the method during each engine idle allows the presence of piston-bore interface leakage to be detected while not intrusively disrupting engine performance since the engine is idling. Also, since the method may be performed during a variety of situations, fuel leak out of the pump compression chamber may be detected in a timely fashion. Also, the method may utilize fewer components without reducing accuracy of the bore wear detection method.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

while an engine is at an idling speed:

increasing pressure in a direct injection fuel rail of the engine to a threshold fuel rail pressure;

computing a target pump rate of a high pressure fuel pump based on a pump performance model;

computing a fuel injection rate;

comparing the target pump rate and the fuel injection rate; and issuing a piston-bore interface leak result based on the comparison.

2. The method of claim 1, wherein the piston-bore interface leak result is abnormal if the comparison determines that the target pump rate is higher than the fuel injection rate by more than a margin.

3. The method of claim 2, wherein the margin includes a value of uncertainty.

4. The method of claim 1, wherein the piston-bore interface leak result is normal if the comparison determines that the target pump rate is equal to or lower than the fuel injection rate plus a margin.

5. The method of claim 4, wherein the margin includes a value of uncertainty.

6. The method of claim 1, wherein the pump performance model is calculated based on fuel loss due to bulk modulus of the fuel and a dead volume of a compression chamber of the high pressure fuel pump, normal leak through the piston-bore interface, and a miscellaneous cause.

7. The method of claim 1, wherein the pump performance model is calculated by a controller with computer readable instructions stored in non-transitory memory, the controller located on-board a vehicle with the engine.

8. The method of claim 1, wherein the fuel injection rate is computed based on measurements from one or more sensors of the engine.

9. A method, comprising:

upon completion of an initiation condition and while an engine is at an idling speed:

increasing pressure in a direct injection fuel rail of the engine to a threshold fuel rail pressure;

computing a target pump rate of a high pressure fuel pump based on a pump performance model;

computing a fuel injection rate;

comparing the target pump rate and the fuel injection rate; and diagnosing a piston-bore interface as abnormally leaking if the target pump rate is higher than the fuel injection rate by more than a margin.

10. The method of claim 9, wherein the margin includes a value of uncertainty.

11. The method of claim 9, wherein the pump performance model is calculated based on fuel loss due to bulk modulus of the fuel and a dead volume of a compression chamber of the high pressure fuel pump, normal leak through the piston-bore interface, and a miscellaneous cause.

12. The method of claim 9, wherein the pump performance model is calculated by a controller with computer readable instructions stored in non-transitory memory, the controller located on-board a vehicle with the engine.

13. The method of claim 9, wherein the fuel injection rate is computed based on measurements from one or more sensors of the engine.

14. The method of claim 9, wherein the initiation condition includes a starting command by a person, an automatic starting command by an engine controller, or a starting command issued every time the engine enters the idling condition.

15. A fuel system, comprising:

one or more direct fuel injectors configured to inject fuel into one or more cylinders of an engine;

a fuel rail fluidly coupled to the one or more direct fuel injectors;

a high pressure fuel pump fluidly coupled to the fuel rail; and a controller with computer readable instructions stored in non-transitory memory for:

while an engine is at an idling speed, increasing pressure in the fuel rail, computing a target pump rate of the high pressure fuel pump based on a pump performance model, computing a fuel injection rate, comparing the target pump rate and the fuel injection rate, and issuing a piston-bore interface leak result based on the comparison.

16. The fuel system of claim 15, wherein the piston-bore interface leak result is abnormal if the comparison determines that the target pump rate is higher than the fuel injection rate by more than a margin.

17. The fuel system of claim 16, wherein the margin includes a value of uncertainty.

18. The fuel system of claim 15, wherein the piston-bore interface leak result is normal if the comparison determines that the target pump rate is lower than the fuel injection rate plus a margin.

19. The fuel system of claim 18, wherein the margin includes a value of uncertainty.

20. The fuel system of claim 18, wherein an amount of fuel leakage corresponding to the normal piston-bore interface leak result lubricates the high pressure fuel pump.

* * * * *